United States Patent [19]

Hughson

[11] Patent Number: 4,548,562

[45] Date of Patent: Oct. 22, 1985

[54] HELICAL GEAR PUMP WITH SPECIFIC HELIX ANGLE, TOOTH CONTACT LENGTH AND CIRCULAR BASE PITCH RELATIONSHIP

[75] Inventor: Douglas Hughson, Southfield, Mich.

[73] Assignee: Ford Motor Company, Dearborn, Mich.

[21] Appl. No.: 432,889

[22] PCT Filed: Sep. 7, 1982

[86] PCT No.: PCT/US82/01215

§ 371 Date: Sep. 7, 1982

§ 102(e) Date: Sep. 7, 1982

[87] PCT Pub. No.: WO84/01004

PCT Pub. Date: Mar. 15, 1984

[51] Int. Cl.[4] ..... F04C 2/16

[52] U.S. Cl. ..... 418/189; 418/201

[58] Field of Search ..... 418/201-203, 418/197, 189, 190

[56] References Cited

U.S. PATENT DOCUMENTS

| | | | |
|---|---|---|---|
| 2,159,744 | 5/1939 | Maglott | 418/201 |
| 2,193,671 | 3/1940 | Dolza | 418/201 |
| 2,462,924 | 3/1949 | Ungar | 418/201 |
| 2,746,394 | 5/1956 | Dolza et al. | 418/201 |
| 2,871,794 | 2/1959 | Mosbacher | 418/201 |
| 2,996,999 | 8/1961 | Trautman | 418/201 |
| 4,193,749 | 3/1980 | Yamazaki et al. | 418/201 |
| 4,210,410 | 7/1980 | Ohtani | 418/201 |
| 4,290,739 | 9/1981 | Korse | 418/189 |
| 4,371,324 | 2/1983 | Gustafsson | 418/201 |

*Primary Examiner*—John J. Vrablik

*Attorney, Agent, or Firm*—Donald J. Harrington; Keith L. Zerschling

[57] ABSTRACT

A helical, positive displacement, external gear pump having a gear contact ratio greater than unity wherein the space between two meshing gear teeth registers with the cutoff edge of the outlet port at one end of the space and as it registers with the inlet edge of the inlet port at the opposite end of the space thereby eliminates the need for providing end plate recesses.

2 Claims, 7 Drawing Figures

HELICAL GEAR PUMP WITH SPECIFIC HELIX ANGLE, TOOTH CONTACT LENGTH AND CIRCULAR BASE PITCH RELATIONSHIP

TECHNICAL FIELD

This invention relates to a hydraulic pump. More particularly it relates to positive displacement hydraulic pumps wherein the pumping elements comprise intermeshing, external, helical gears.

BACKGROUND ART

This invention is an improvement in positive displacement pumps having intermeshing gears. Various kinds of positive displacement pumps are known in the fluid machinery art including vane pumps wherein a pump rotor rotates in a pumping cavity and carries on its periphery pumping vanes, slipper pumps, having loosely mounted slippers carried by a pump rotor in a pumping cavity, and internal-external gear pumps wherein one pumping element is an external gear and the companion meshing gear element is an internal gear. My invention comprises a positive displacement pump which, unlike the previously described positive displacement pump, comprises two external gears that mesh in their respective pump cavities. Examples of such external gear pumps are shown, for example, in U.S. Pat. No. 2,746,394 (Dolza et al); U.S. Pat. No. 2,996,999 (Trautman); and U.S. Pat. No. 2,871,794 (Mosbacher).

In a gear pump of the kind shown in the above-idenified prior art patents, the cavities between the external gear teeth and the surrounding pump housing act as fluid pumping chambers as they carry fluid from an inlet port to an outlet port upon rotation of the gears. As in the case of most gearing systems, the helical gear teeth of my improved pump have a contact ratio for the gears that is greater than unity. Thus there is an overlap in the gear tooth engagement pattern as one pair of meshing teeth begins to engage prior to disengagement of the preceding pair of meshing gear teeth. This creates in the space between the meshing gear teeth a volume of fluid which at one instant decreases in volume and at another instant increases in volume. The instant at which the volume changes from a compression mode to an expanding mode corresponds to the instant that the line of action for the meshing gears intersects the line connecting the centers of rotation of the gears.

In order to avoid a hydraulic lock that would reduce pumping efficiency and create pump noise as well as undesirable hydraulic pressure forces in the pump, it is common practice to use an end plate an each axial side of the meshing pump gears and to provide a recess in the end plates to permit discharge of the fluid trapped in the gear tooth space thus providing communication between that space and the adjacent port. This provides a pressure relief that prevents a buildup of pressure in the trapped fluid in the tooth space of the meshing gear teeth.

The improvements of my invention make it possible to eliminate the need for using ported end plates in a gear pump assembly of this kind. This involves a strategic port design so that each tooth space volume between two meshing teeth in a helical gear pump having a form contact ratio greater than unity registers with the cutoff edge of the outlet cavity at one axial end of the tooth at the same instant the opposite end of the same tooth space volume registers with the inlet edge of the inlet port. Thus there is no opportunity for a pressure pulsation to occur in the fluid trapped between two meshing gear teeth. The use of ported plates with pressure recesses at the ends of the pump gears is not required. The assembly thus is simplified, its cost reduced and the space required for a given pump capacity is reduced.

BEST MODE FOR CARRYING OUT THE INVENTION

Figure 1:
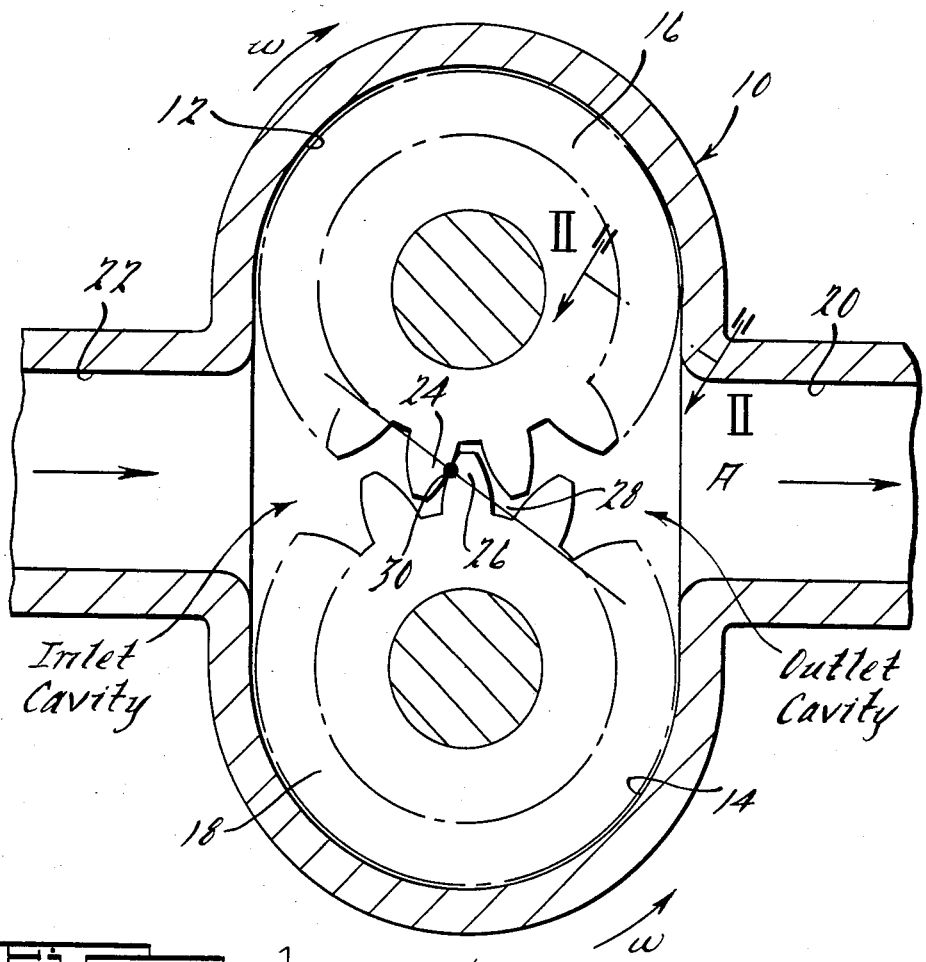
FIG. 1 is a schematic cross-sectional view of a gear pump showing the meshing pump gears, the inlet port and the outlet port.

In FIG. 1 numeral 10 generally designates a pump housing. It comprises two circular pump chambers 12 and 14. A first pump gear 16 is journalled for rotation in pump cavity 12 and a corresponding pump gear is journalled for rotation in pump cavity 14. Gears 16 and 18 mesh with each other as shown.

The pump housing 10 has formed therein at one side of the assembly an outlet port 20 communicating with the outlet cavity. An inlet port 22 is formed in the housing 10 on the opposite side of the assembly. Inlet port 22 communicates with the inlet cavity.

The outside diameter of the external gear teeth for pump gear 16 is chosen so that a close running clearance exists between the tips of the teeth of the gear 18 and the surrounding wall of the pump cavity 12. The clearance between the wall of the pump cavity and the gear teeth is sufficiently close to effect a sealing engagement as fluid is carried in the tooth spaces for the pump gear 16 from the port 22 to the port 20 upon rotation of the gears 16 and 18 in the direction of the rotation vectors shown in FIG. 1.

Pump gear 18 cooperates with the cavity 14 in a fashion similar to the mode of cooperation of the pump gear 16 with respect to the pump cavity 12. Like the gear 16, the gear 18 carries fluid from the port 22 to the port 20 as the tooth spaces in the gear rotate in the direction of the rotation vector w shown in FIG. 1. The meshing teeth 24 and 26 for the gears 16 and 18, respectively, provide an effective seal between the ports 22 and 20.

The side walls for the housing portion 10 on the axial sides of the gear 16 provide sealing engagement with the ends of the gear teeth of gears 16 and 18 thus sealing the ends of the spaces between the gear teeth.

Figure 2:
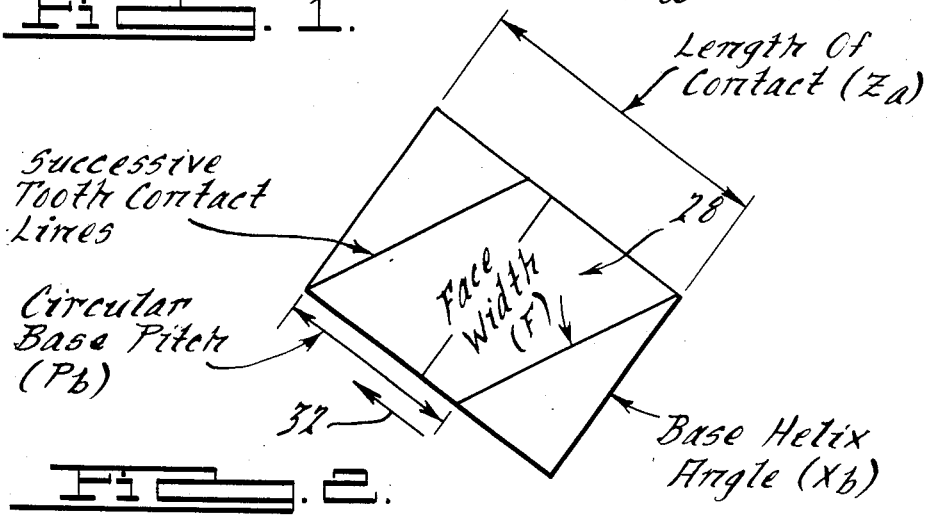
FIG. 2 is a view of the plane of contact of the gear teeth of FIG. 1 as seen from the perspective of section line II—II of FIG. 1.
Figure 5:
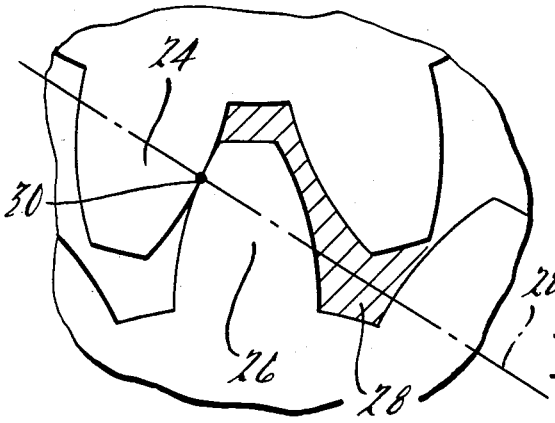
FIG. 5 is an enlargement of a portion of the meshing gears for the gear pump assembly of FIG. 1 showing a volume of trapped liquid in the tooth space between two meshing gear teeth.
Figure 5A:
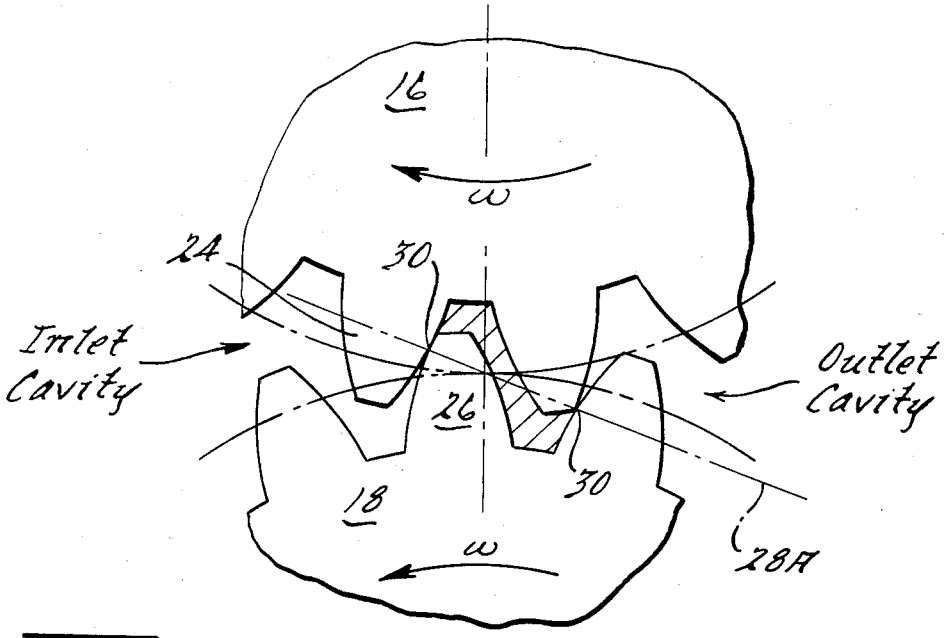
FIG. 5A shows an enlargement of a portion of the meshing gear teeth of FIG. 1 at a section near one end of the teeth at the instant that the communication between the tooth space volume and the outlet cavity ceases.
Figure 5B:
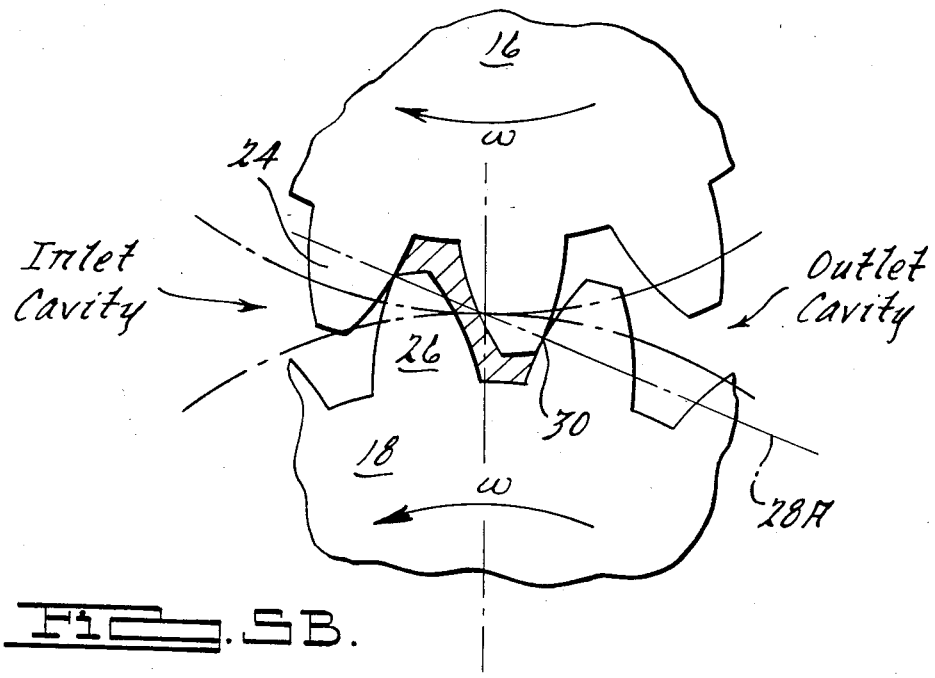
FIG. 5B is a sketch similar to FIG. 5A but it shows the meshing gear teeth at a section near the other end of the teeth at the instant represented by FIG. 5A wherein communication between the tooth space volume and the inlet cavity begins.

The teeth 24 and 26 for the gears 16 and 18, respectively, are helical teeth having a helix angle $X_b$ shown in FIG. 2. As in the case of most meshing gear teeth for fluid pumps, the form contact ratio for the teeth is greater than unity. For purposes of this description, form contact ratio means the utilized length of the path of contact divided by the circular base pitch. See FIG. 2. Thus there are two active pressure points in any given instant during the operation of the gears as the pressure points traverse a plane of action or plane of contact designated generally by reference numeral 28 in FIG. 2. This plane of action 28, when viewed from its end in the cross section sketch of FIG. 5, appears as a line of action and this line is designated by the symbol 28A in FIG. 5. One of the contact points in the line of action is shown in FIGS. 1 and 5 by reference character 30.

The successive tooth contact lines for the meshing gear teeth, upon rotation of the pump gears, move in the direction of the directional arrow 32 in FIG. 2 thus defining the contact plane 28A. The circular base pitch for the gearing is represented in FIG. 2 by the dimension $P_b$. The face width for the plane of contact is identified by the dimension F. The helix angle for the teeth, as mentioned earlier, is shown at $X_b$. The length of contact for the respective gear teeth for the pump gears carries the dimension $Z_a$ in FIG. 2. The relationship between these dimensions is expressed by the following equation:

$$\text{tangent } X_b = \frac{Z_a - P_b}{F}$$

Figure 4:
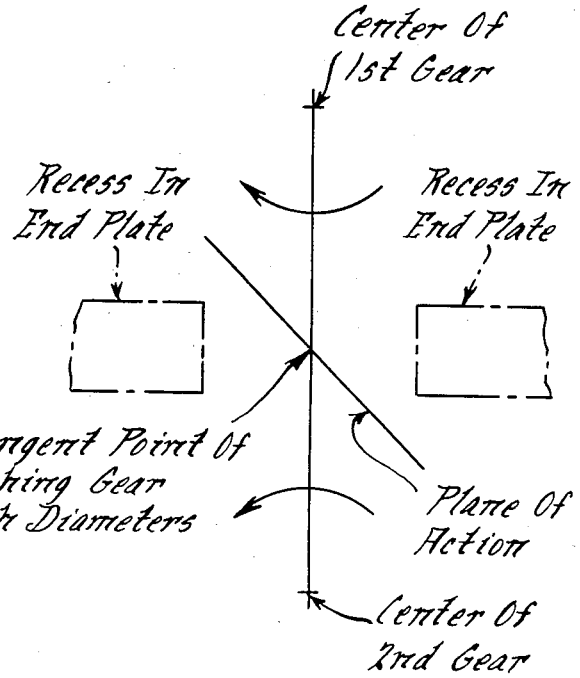
FIG. 4 is a diagram showing the geometry of two meshing gears for a gear pump assembly such as that shown in FIG. 1.

FIG. 4 shows the geometry of gear teeth action from the perspective of the direction of the axes for the gears. In this view the centers of the pumping gears carry identifying labels and the plane of action appears in that end view as a line of action. In FIG. 4 the tangent point for the pitch diameters of the meshing gears is the point of intersection of the plane of action or line of action shown in FIG. 4 with the centerline connecting the two centers of the gears as shown.

In FIG. 4 the recesses in the end plates that normally would be required in a gear pump of this kind have been illustrated by phantom lines. If the recesses are considered part of FIG. 4, FIG. 4 would be similar to the geometry of the pump gears for a prior art pump assembly. In the instant invention, however, the recesses are not required for reasons explained previously; that is, the space between the meshing gear teeth for the helical gears of FIG. 1 of the improved construction of this invention communicates at one side of the gear with port 20 and the opposite side of that same space communicates with port 22. Communication between port 20 and that space is cut off at the same instant that communication between that space and the port 22 is established.

In FIG. 5 I have shown a volume of oil trapped between the meshing gear teeth for the gears 16 and 18. The space occupied by this oil can communicate with the port 20 while the space is sealed from the port 22. When the gear rotates until the space no longer communicates with port 20, the oil in the space communicates with port 22 as communication is established.

Figure 3:
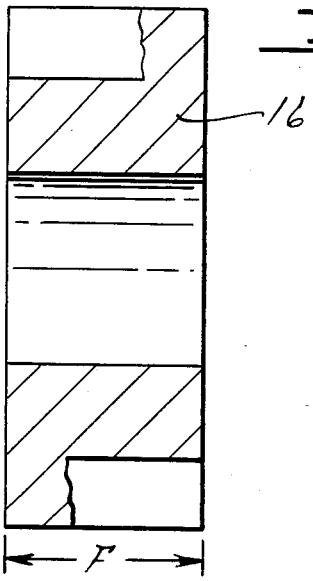
FIG. 3 is a sketch showing the gear geometry of one of the pump gears of FIG. 1.

In FIG. 3 the form contact ratio $$r_f = \frac{Z_a}{P_b}$$

where $Z_a$, as mentioned earlier, is equal to the utilized length of contact for the meshing gear teeth and $P_b$ is equal to the circular base pitch. Symbol $r_h$ is the helical contact ratio and is equal to $$\frac{\text{F tangent } X_b}{P_b}$$

The relationship between the form contact ratio and the helical contact ratio can be expressed as follows:

$$r_f = 1 + r_h$$

The key equation for designing the gears to effect a proper intake and outlet port location can be expressed by the equation:

$$\text{tangent } X_b = \frac{(Z_a - P_b)}{F}$$

If that relationship is established the fluid between the tooth spaces illustrated in FIG. 5 will communicate with either one port or the other but will not be trapped notwithstanding the fact that the form contact ratio is greater than unity as seen by the above relationship described with reference to FIG. 2.

INDUSTRIAL APPLICABILITY

This invention relates to the art of fluid machinery and especially fluid pumps of the positive displacement type known as external gear pumps. It is capable of being used as a pressure source in an automobile as a power steering pump or as an engine lubrication oil pump, although it will be apparent that it has other industrial applications requiring the use of positive displacement pumps with incompressible fluids.

I claim:

1. A positive displacement external hydraulic gear pump comprising a pump housing having two pumping chambers;

a first pumping gear journalled rotatably in one pumping chamber and a second pumping gear meshing with the first pumping gear in a second of said pumping chambers;

an inlet port and inlet cavity in said housing on one side of said gears in the region of the meshing teeth for the respective gears and an outlet port and outlet cavity on the opposite side of said meshing teeth;

said gears having teeth that are helical, the form contact ratio for the meshing helical teeth being greater than unity and engaging along tooth contact lines;

the tooth space volumes between pump teeth for said gears being adapted to communicate sequentially with said outlet cavity and said inlet cavity;

such communication between the inlet cavity and each tooth space volume bounded at successive instants by two successive tooth contact lines being established as such communication between the outlet cavity and that tooth space volume is interrupted whereby that tooth space volume communicates only with said outlet cavity immediately before each such instant and only with said inlet cavity immediately after that instant;

the relationship between the base helix angle of said teeth and the length of tooth contact for said gears having a specified circular base pitch and face width is expressed as follows:

$$\text{tangent } X_b = \frac{(Z_a - P_b)}{F}$$

where $X_b$=base helix angle, $Z_a$=length of tooth contact, F=face width and $P_b$=circular base pitch.

2. The combination as set forth in claim 1 wherein said pumping chambers have an inner chamber wall registering in close running and sealing relationship with respect to the addendum circles of the teeth of said gears and having end surfaces in sealing relationship with respect to the ends of the helical gear teeth of said gears.

* * * * *